United States Patent [19]

Pool

[11] 4,022,477

[45] May 10, 1977

[54] METHOD FOR MAKING PREFORMED LACROSSE NETTING

[76] Inventor: Robert B. Pool, 564 Charleston Road, Willingboro, N.J. 08046

[22] Filed: Oct. 6, 1976

[21] Appl. No.: 730,078

Related U.S. Application Data

[60] Division of Ser. No. 562,217, March 26, 1975, which is a continuation-in-part of Ser. No. 347,709, April 4, 1973, abandoned.

[52] U.S. Cl. ..... 273/96 D; 29/433

[51] Int. Cl.[2] ..... A63B 59/02

[58] Field of Search ..... 273/96 D, 73 D, 73 B, 273/73 R; 29/433

[56] References Cited

UNITED STATES PATENTS

| | | | |
|---|---|---|---|
| 2,142,527 | 1/1939 | Pool | 273/96 D |
| 3,507,495 | 4/1970 | Tucker et al. | 273/96 D |
| 3,702,702 | 11/1972 | Hoult | 273/96 D |
| 3,822,062 | 7/1974 | Tucker et al. | 273/96 D |
| 3,905,088 | 9/1975 | Tucker et al. | 273/96 D X |

FOREIGN PATENTS OR APPLICATIONS

| | | | |
|---|---|---|---|
| 396,946 | 8/1933 | United Kingdom | 273/96 D |
| 331,925 | 7/1930 | United Kingdom | 273/73 D |
| 204,113 | 9/1923 | United Kingdom | 273/73 L |

*Primary Examiner*—William H. Grieb
*Attorney, Agent, or Firm*—J. Wesley Everett

[57] ABSTRACT

A preformed net for V-shaped lacrosse stick head frames defining a tapered V-shape net area, the forward end of the frame being the wide area and the rear end of the frame being the narrower area having a handle extending rearwardly therefrom; and the method of constructing the net outside the frame. The net is formed in such a manner that the end of the net adapted to be secured to the forward end of the frame is of such width as to fit within the inside edge of the wide outer end of the frame, the width of the remaining portion of the net being wider than the tapered end of the V-shaped frame whereby when the preformed net is laced into the rear narrower portion of the frame the net will extend rearwardly of the frame to form a pocket for receiving and retaining the playing ball.

4 Claims, 27 Drawing Figures

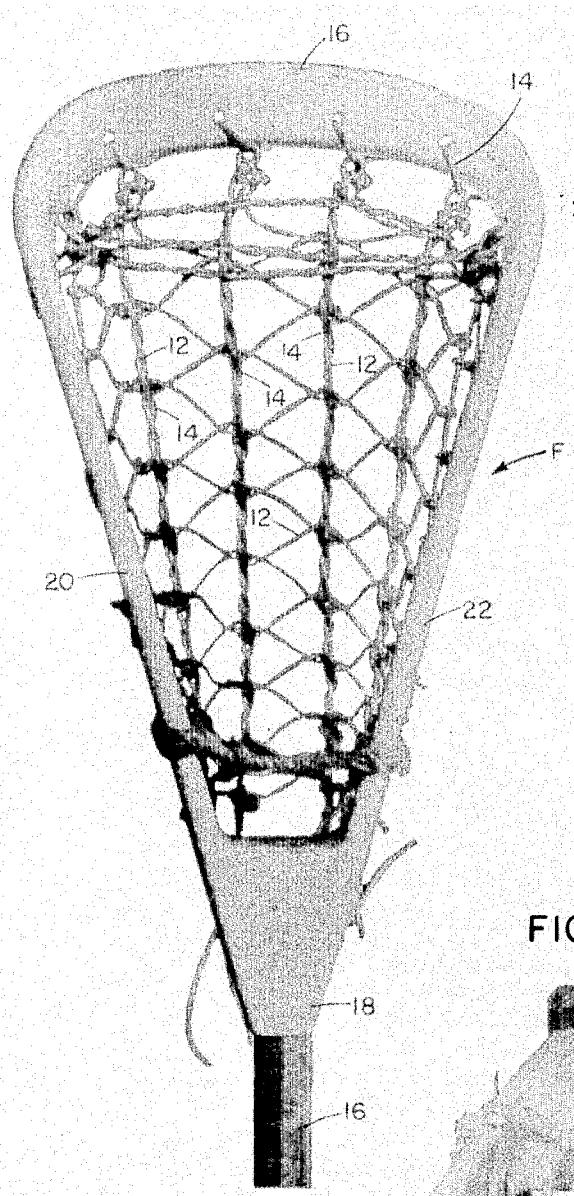
FIG. 3
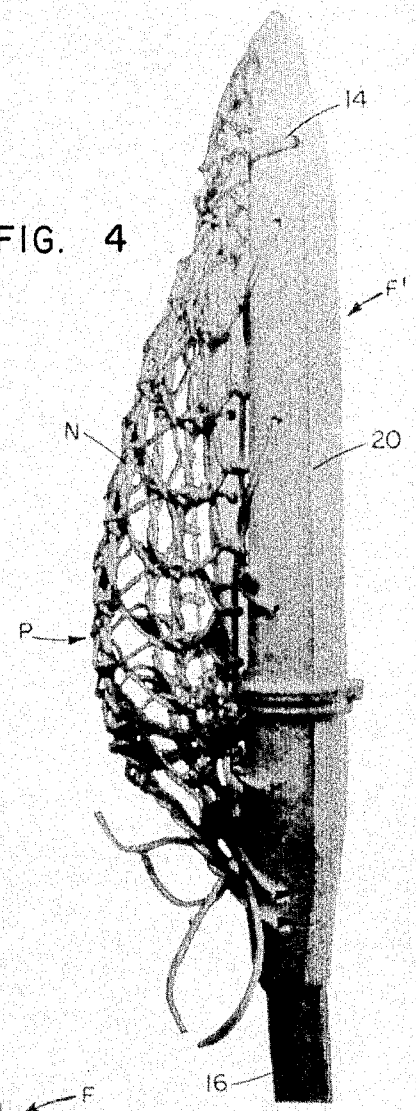
FIG. 4
FIG. 5
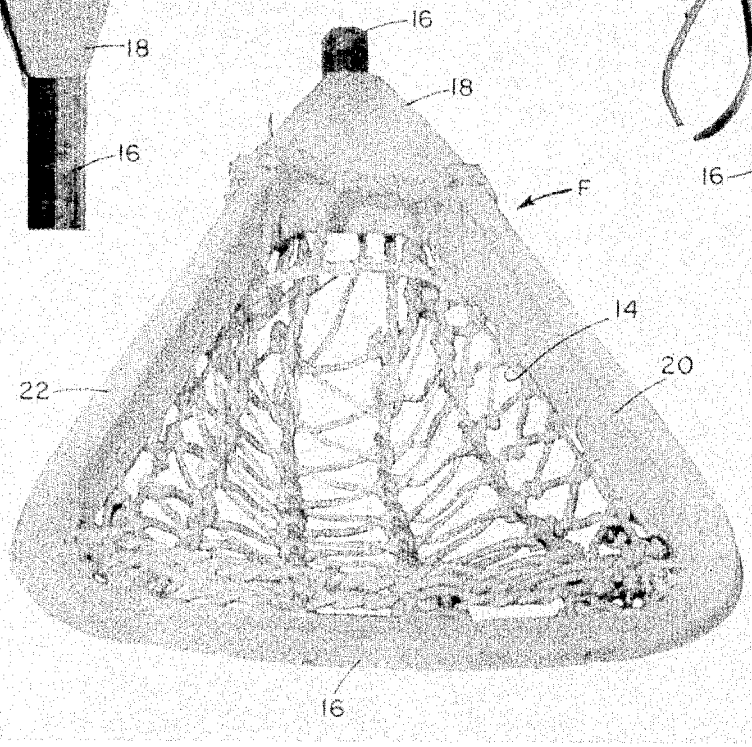

FIG. 25
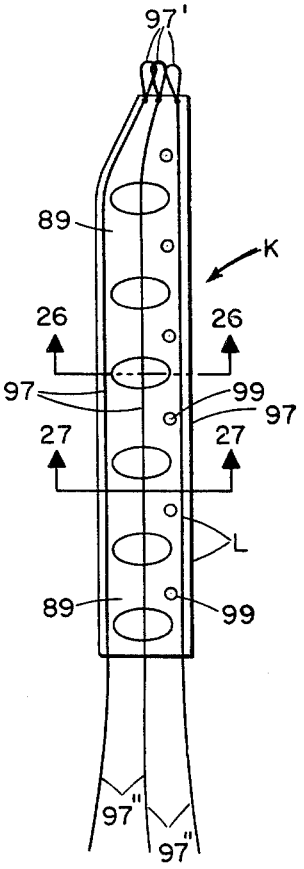
FIG. 9
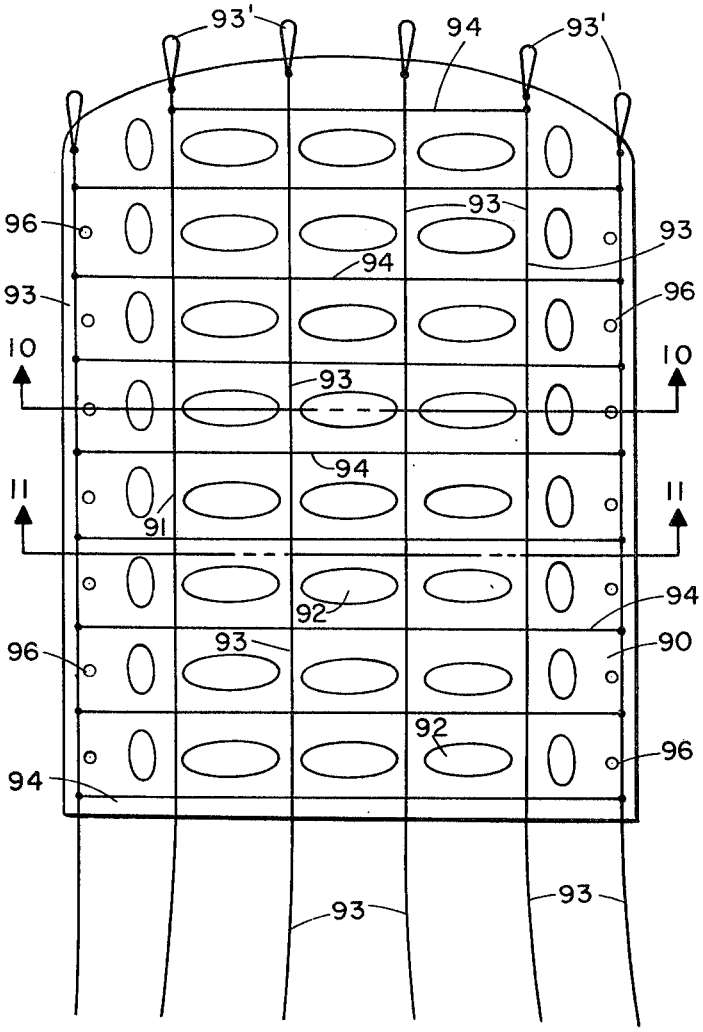
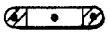
FIG. 26
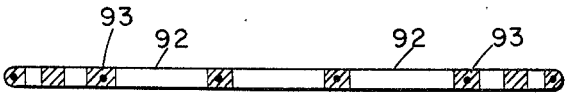
FIG. 10
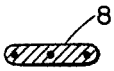
FIG. 27
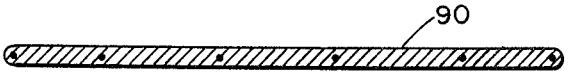
FIG. 11

METHOD FOR MAKING PREFORMED LACROSSE NETTING

This is a divisional application of application, Ser. No. 562,217, filed Mar. 26, 1975 as a continuation-in-part of earlier application Ser. No. 347,709, filed Apr. 4, 1973 now abandoned.

This invention relates to a preformed net for lacrosse stick head frames wherein the stick head frame is of V-shape forming a like shaped net area which the netting is adapted to cover, the forward end of the head frame being the wider portion and tapering inwardly toward the rear of the frame where a handle is provided to support the frame head; and to the method of constructing the netting and the means for attaching the netting to the head frame of the lacrosse stick.

In the past the netting in the head frame of lacrosse sticks has been woven directly in the head frame by tying at least one end of a plurality of longitudinal cords of the net into preformed holes extending along the front edge of the head frame, which is the widest portion of the frame, pulling them taut through corresponding opposite openings formed at the rear end of the head frame and weaving cross-cords laterally of the head and attaching these cross-cords to the longitudinal cords and to the side walls of either a double wall head or to the single wall in a single wall head. It has always been a difficult and arduous task to weave this netting into the head frame and in addition it required personnel with a particular type of skill which are somewhat limited in number. When the netting wears out the head is generally restrung by local craftsmen, which is quite expensive, along with delays in getting the stick restrung.

No records has been found where a netting for lacrosse head frames was formed outside the frame and later attached thereto.

One subject of the present invention is to provide a netting for lacrosse stick head frames which may be preformed and later assembled with the head frame with limited skill and a great saving in time and cost.

Another object of the invention is to make it possible for a worn out netting to be quickly and inexpensively replaced by an individual.

Another object of the invention is to provide a plurality of net forms having the same advantages of being formed outside the head frame and later attached thereto.

Another object of the invention is to provide a method of creating a pocket of uniform predetermined size and depth in the netting in which the playing ball is received and carried, and from which the ball is propelled.

Another object of the invention is to provide a method of constructing a woven net of flexible, cord-like material for easy weaving of the netting and later treating the netting with a preparation that will hold the netting in semirigid, bendable, predetermined form.

A further object of the invention is to provide a preformed net for lacrosse stick heads wherein the major portion of the netting is in a molded plastic form.

A still further object of the invention is to provide an apparatus upon which the woven netting is constructed.

While several objects of the invention have been pointed out, other objects, uses and advantages will become more apparent as the nature of the invention is more fully disclosed in the detail description with reference to the accompanying drawings as follows:

FIG. 3 is an elevational plan view of the woven netting shown in FIG. 1, secured to a closed frame lacrosse stick head.

FIGS. 4 and 5 are a side view and front view of the same.

FIG. 9 is an elevational view of another form of molded netting.

FIG. 10 is a sectional view taken along line 10—10 of FIG. 9.

FIG. 11 is a sectional view taken along line 11—11 of FIG. 9.

FIG. 25 is a schematic view in elevation of a molded fence used with an open side lacrosse stick head frame.

Frame 26 is a sectional view taken on line 26—26 of FIG. 25.

FIG. 27 is a sectional view taken on line 27—27 of FIG. 25.

Figure 1:
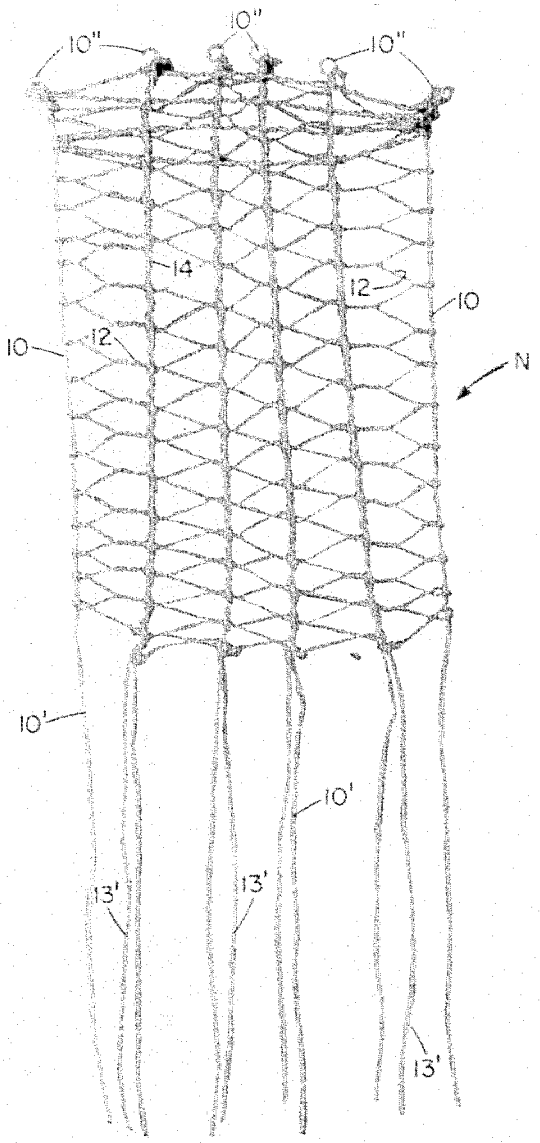
FIG. 1 is an elevational plan view of a woven form of preformed netting.
Figure 2:
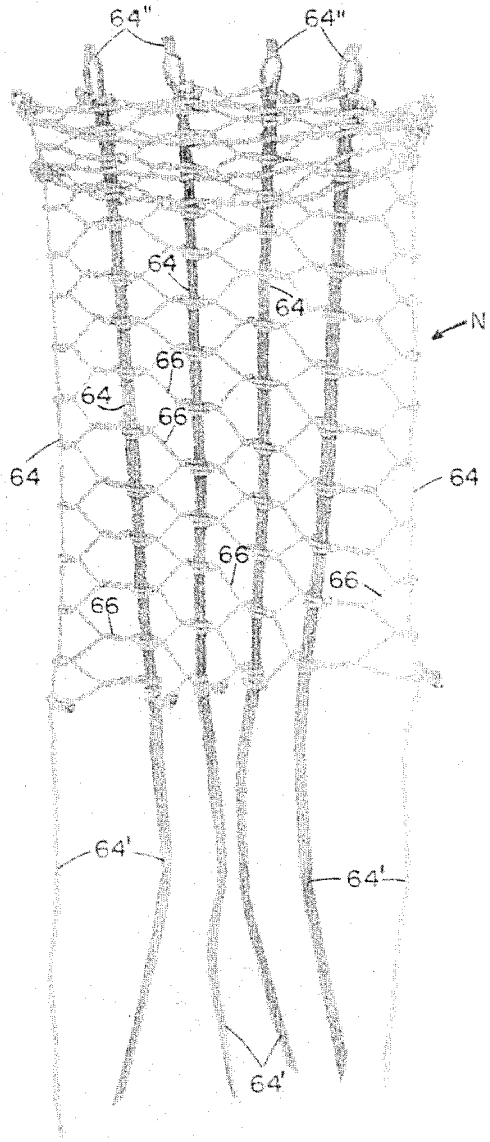
FIG. 2 is an elevational plan view of another form of woven preformed netting.
Figure 6:
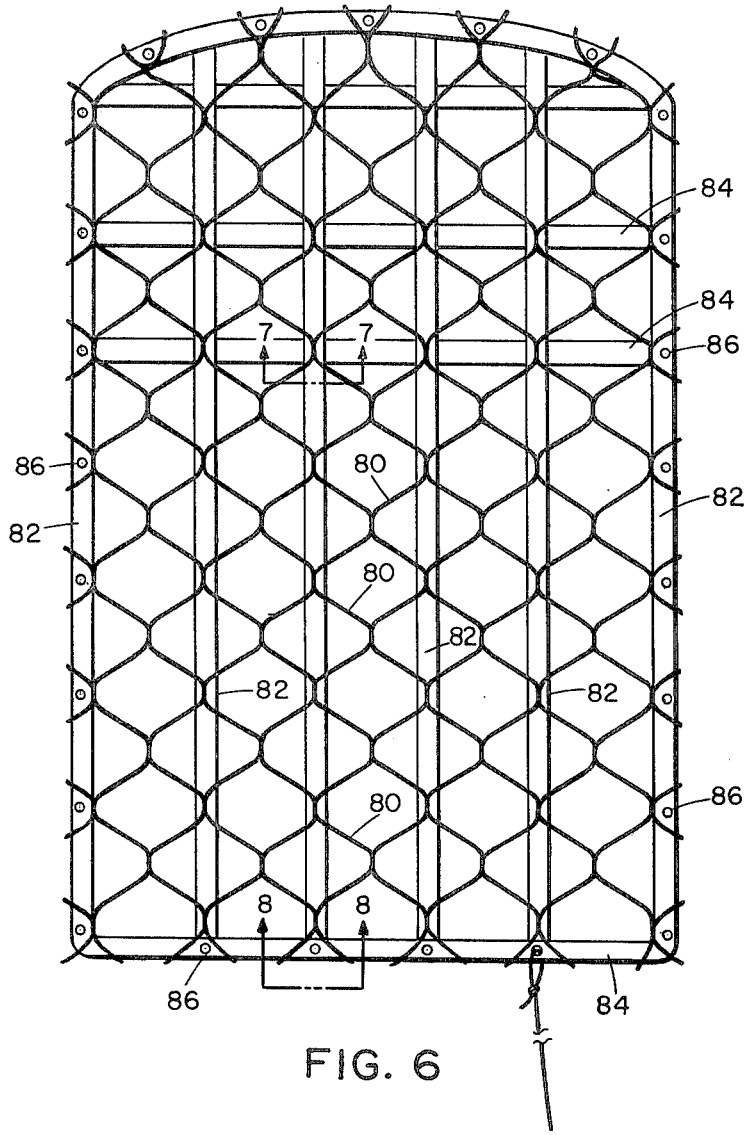
FIG. 6 is an elevational plan view of one form of molded netting.

This invention relates to preformed nets for lacrosse stick head frames. The net may be of various types. FIG. 1 shows one form of woven net. FIG. 2 shows another type of woven net. FIG. 6 shows one form of molded netting and FIG. 9 shows still another type of molded netting. Each type of molded netting may be provided with longitudinal and/or lateral cords or strips extending through or under the molded netting for supporting the same. The invention also relates to the method of making the several types of netting.

The first type of netting to be described is the woven form shown in FIG. 1, along with the apparatus, or jig as it is sometimes referred to, on which the net is woven. In the present description the wide portion of the V-shaped head frame is referred to as the forward or toe end of the frame, and the narrower portion of the frame is referred to as the rear or heel portion of the frame.

The woven netting N (FIG. 1) is of general rectangular form and is provided with a plurality of longitudinal cords 10 having extended portions 10' extending from the rear of the net for securing the rear end of the net to the rear end of the head frame, while the opposite end of the longitudinal cords are provided with small loops 10'' into which a suitable lacing 14 is passed for attaching the forward end of the netting to the forward end of the head frame. Extending between the longitudinal cords 10 is a plurality of cross cords 12 which are looped about the longitudinal cords. Over the looped ends of the cross cords is an overlapping cord 13, which is normally the extension of the longitudinal cord 10, for holding the loops of the cross cords looped about the longitudinal cords 10 in position on the longitudinal cords which also prevents wear on the loop area of the cross cords where the cross cords generally wear first. The finished woven netting of FIG. 1 is then laced into the head frame, as shown in FIGS. 3, 4 and 5. The laced-in woven netting as shown in FIG. 1 is illustrated with a double wall head frame, as shown in FIG. 12, and is referred to by the letter F.

The forward end of the netting is laced to the broad forward end of the head frame by passing the lacing 14 through the loops 10'' of the forward end of the netting This forward end portion of the netting is constructed to fit tightly along the inside edge of the wide portion of the frame while the extended portions 10' of the longitudinal cords and the portion 13' of the cover cords 13 are extended to the rear of the head frame and secured thereto. The lacing is then extended along the side of the netting and the side wall portion of the frame securing the side wall of the netting to the frame. As the frame is tapered toward the rear and the netting is of substantially rectangular form the net will be extended outwardly toward the rear of the frame to form a pocket P which gradually slopes upwardly toward the forward broad end of the head frame as shown in FIGS. 4 and 5.

Figure 12:
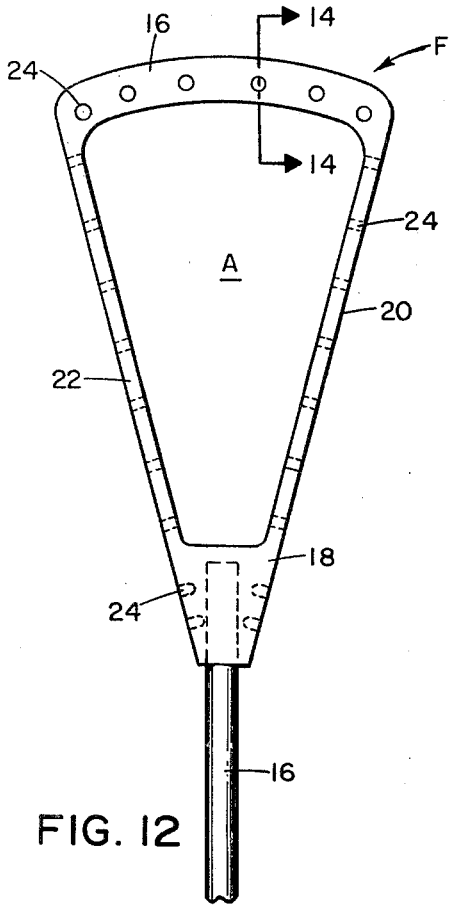
FIG. 12 is a plan view in elevation of a closed wall lacrosse stick head frame and handle.
Figure 13:
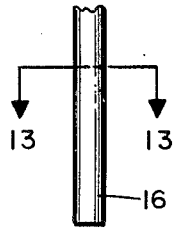
FIG. 13 is a sectional view taken along line 13—13 of FIG. 12.
Figure 13:
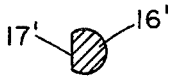
Figure 15:
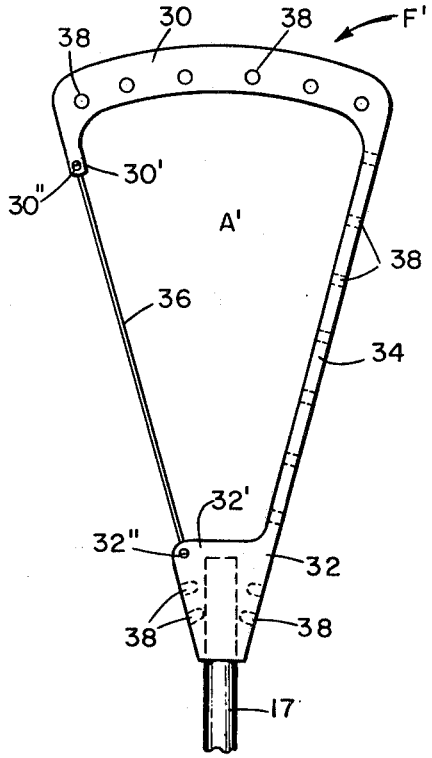
FIG. 15 is a front elevational view of a single wall lacrosse stick head frame.
Figure 14:
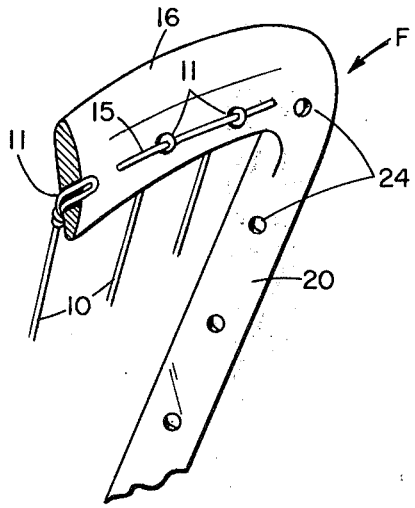
FIG. 14 is an enlarged fragmentary perspective view taken along line 14—14 of FIG. 12.
Figure 16:
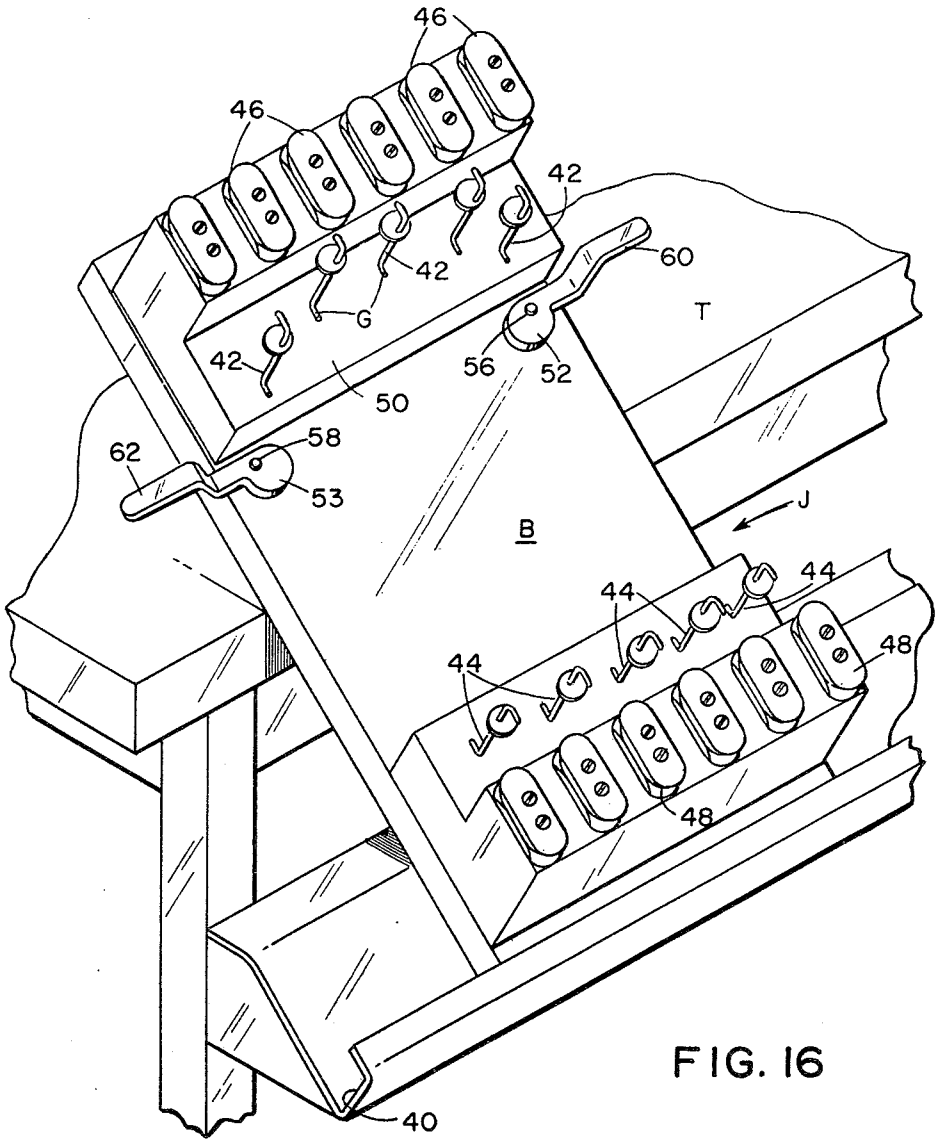
FIG. 16 is a view in perspective of an apparatus on which the preformed woven netting is made.
Figure 17:
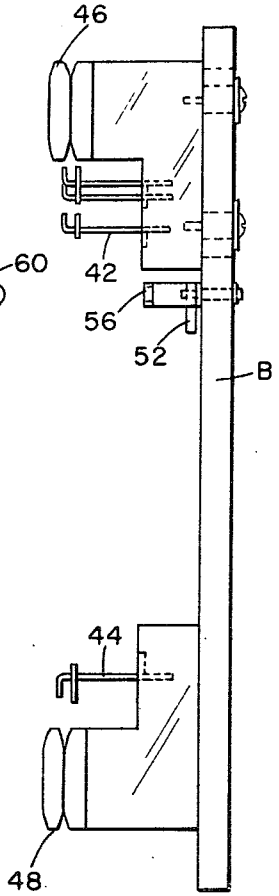
FIG. 17 is a side view in elevation of the apparatus shown in FIG. 16.
Figure 18:
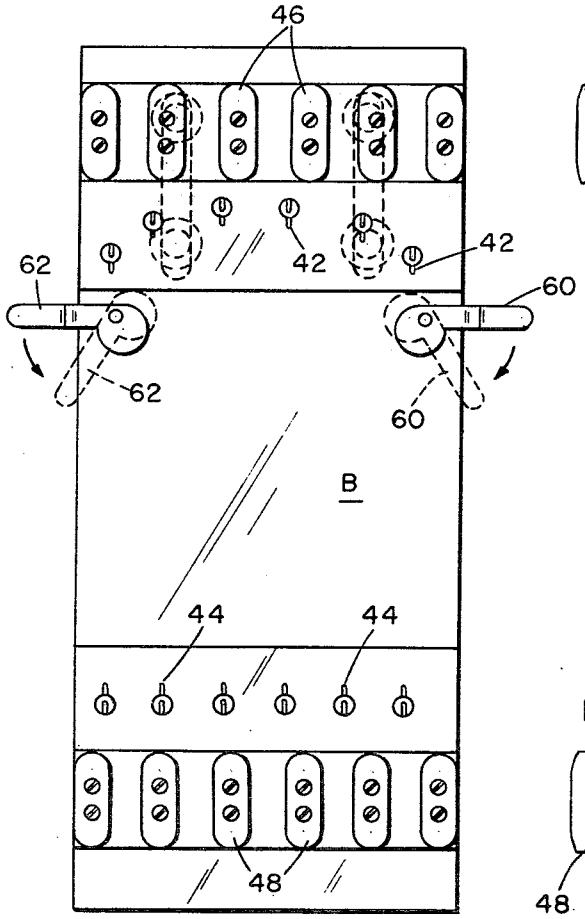
FIG. 18 is a top plan view of the apparatus shown in FIG. 16.

Lacrosse stick head frames are at present constructed in two general forms, the double wall head frame as shown in FIG. 12, and the single wall head frame as shown in FIG. 15.

The double wall head frame, as shown in FIG. 12, is of unitary construction being provided with a wide forward end portion 16, a narrower rear portion 18, and two side wall portions 20 and 22 respectively which connect the lateral ends of the wide forward end portion 16 with the narrower rear end portion 18 to form a V-shaped head frame which provides a V-shaped net area A (see FIG. 12.) This is the type of double wall head frame shown in FIGS. 3, 4 and 5 into which the woven net shown in FIG. 1 is laced. The head frame is provided with small apertures 24 surrounding the frame through which the lacing 14 holding the net to the frame is laced.

The head frame shown in FIG. 15, and designated by the letter F', is referred to as a single wall head frame, which is preferred by some players. This single wall head frame is constructed with a wide forward end portion 30, a narrower rear end portion 32 and a single side wall 34. There is no second side wall opposite the wall 34 as shown at 22 in FIG. 12. In place thereof is provided a cord or rigid support 36 such as a fiber glass rod or other suitable material which may be affixed or attached to the portion 30' and the portion 32' of the head frame F'. The member 36 may be held to the frame by extending the same through apertures 30'' and 32'', or in any other convenient manner. Or the member 36 may be a part of the netting itself. However, the member 36 may be added at the time of the molding of the head frame and become a part thereof. The rear surface of the member 36 is substantially in a plane running through or along the back edge of the frame. This support has two functions, one, to reenforce the end 30' of the member 30, and two, to support the side of the netting opposite the side 34. This head frame F' is also provided with apertures 38 for receiving the lacing to hold the net in the frame. The net area is designated as A'.

Both the double and single wall head frames are provided with a handle 16 and 17 wherein the handle is of a definite contour on one side as shown at 17' in order that the player will know by gripping the handle what position the head frame is in.

FIGS. 16–18 and FIGS. 23 and 24 disclose an apparatus J for weaving the netting shown in FIGS. 1 and 2. The apparatus is provided with a base B wherein the top of the base may be supported at an angle away from the weaver. Attached to the table T is a channel member 40 to maintain the base at the proper angle while the weaving is being performed. Positioned on the upper face of the base B are two opposite groups G and H of a plurality of pins, each pin in one group having a corresponding pin in the opposite group. The groups are spread apart for the length the net is to take. The pins 42 and the pins 44 are spaced apart to correspond to the width of the net.

Immediately outwardly from the upper end of each of the pins 42 and 44 are means 46 and 48 respectively for locking the longitudinal cords in place during the weaving operation. One group (G) of pins may be carried by a member 50 movable relative to the base B in order that the tension on all of the longitudinal cords may be increased or decreased at one time if desired. The member 50 is moved by the members 52 and 54 eccentrically mounted on the bearings 56 and 58. The eccentric members are rotated by the handles 60 and 62.

In one form of the apparatus each of the pins may be easily removable for releasing the completed woven net. However, in the type of apparatus wherein the whole group of pins is movable as a unit as just described, the pins may be fixed to their holding means and the net loosened by moving one group of pins relative to the other group of pins.

The group of pins supporting the ends of the longitudinal cords adjacent the forward end of the net are normally set in an arc, or in whatever form the outward end of the head frame is constructed, while the pins in the other group are placed in a straight line perpendicular to the longitudinal cords.

Figure 19:
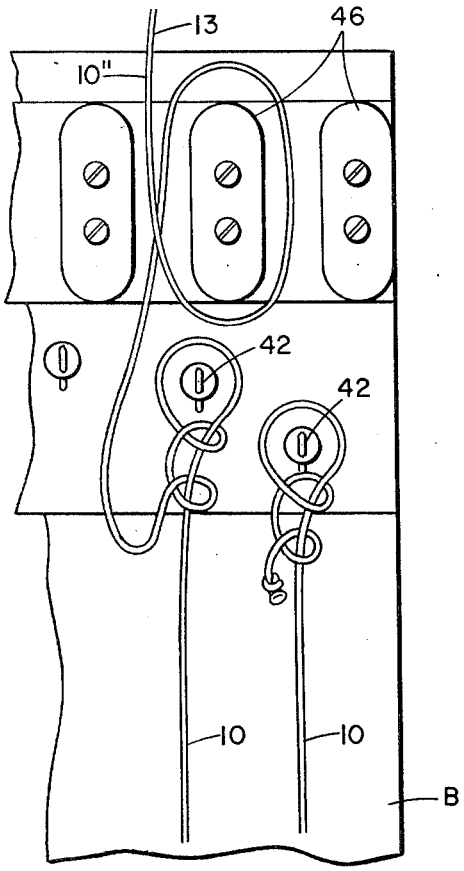
FIG. 19 is a fragmentary plan view in elevation of the apparatus showing the first step in the construction of the preformed woven net shown in FIG. 1.
Figure 19:
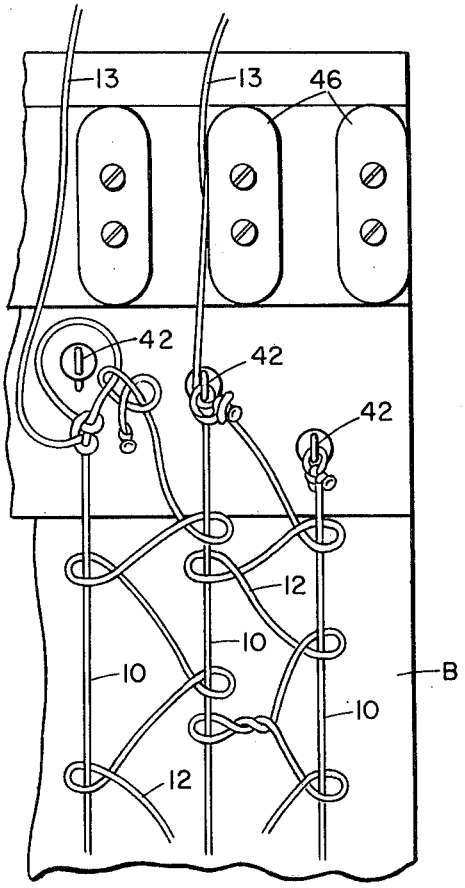
Figure 19:
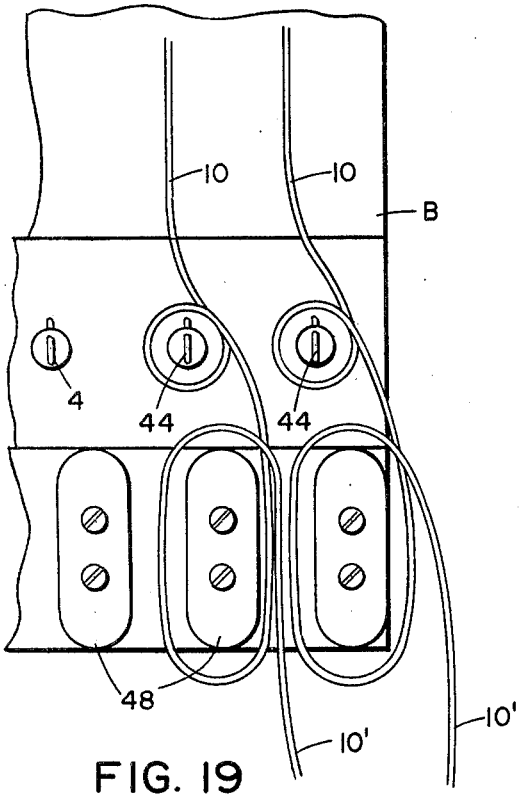
Figure 20:
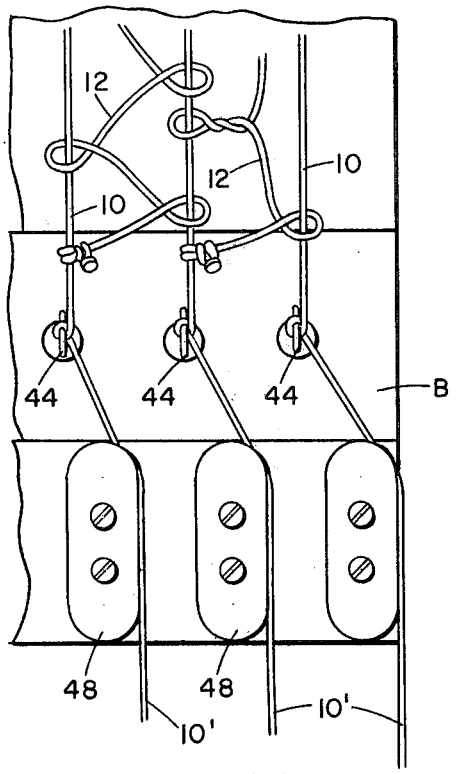
FIG. 20 shows a fragmentary plan view in elevation of the apparatus illustrating the second step in weaving the preformed net shown in FIG. 1.
Figure 21:
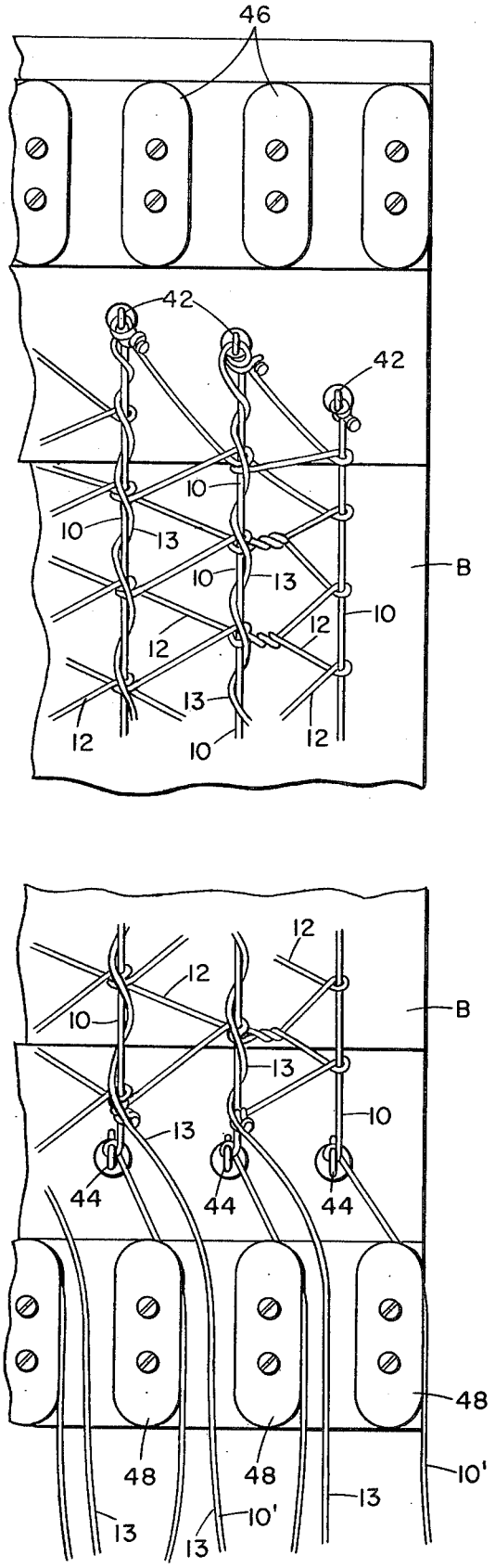
FIG. 21 is a fragmentary plan view in elevation of the apparatus illustrating the third step in weaving the preformed net shown in FIG. 1.

In FIGS. 19 to 23 there is illustrated the method of weaving the net shown in FIG. 1. The first steps are shown in FIGS. 19 and 20. A plurality of longitudinal cords 10 are looped and tied about the upper end of two opposite pins 42 and 44 on each side of the net area. The longitudinal cords extend across the net area over which the net is to be woven. The net may be started at either side of the apparatus. The longitudinal cords are drawn taut between the two pins and the extended ends of the cords are preferably secured in the cord holders 46 and 48. The ends 10' of the longitudinal cords extend rearwardly of the net beyond the apparatus and are used to secure the net to the rear or heel of the head frame. Additional overlapping cords 13 are provided for the longitudinal cords 10 especially those longitudinal cords extending through the center of the net which will be more specifically referred to. For practical operation it is preferable to not place more than three longitudinal cords 10 on the apparatus before weaving in the first cross cords 12. The first cross cord is woven between the first two adjacent longitudinal cords, and the second cord is woven between the second and third longitudinal cords. Additional longitudinal cords and cross cords are woven in like manner until the weaving is completed. The cross cords are looped tightly about the longitudinal cords as shown in FIG. 21, after which the cover cord 13 is wrapped about the looped area of the cross cords fastening them to the longitudinal cords and extending over the loops at least on one side of the netting for protecting the loops of the cross cords from wear by the playing ball.

The cords from which the net is woven are generally of a nylon type and quite soft and pliable. Therefore, the net may be treated with a stiffening agent prior to removal from the apparatus, which may also provide a covering for the netting.

Figure 22:
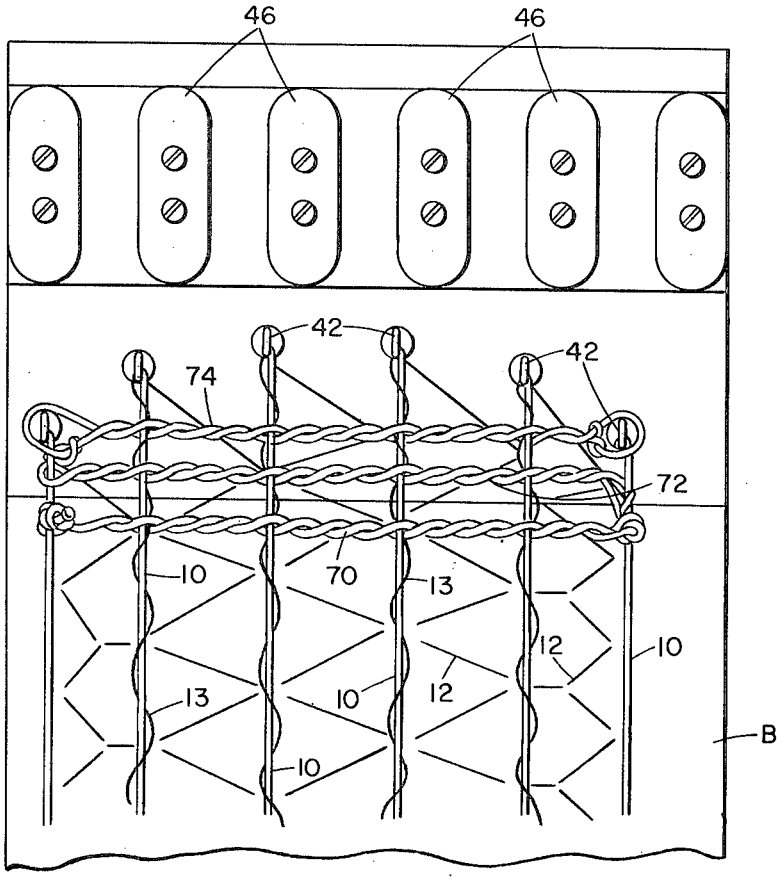
FIG. 22 is a fragmentary plan view in elevation of the apparatus showing the forward end of a completed prewoven net before the net is removed from the apparatus and further illustrates the reenforcing bridge at the forward end of the netting.

FIG. 22 illustrates a plurality of lateral reenforcing members 70, 72 and 74 woven into the net adjacent the forward end of the net for reenforcing the outer end thereof and to provide a level area adjacent the forward end of the net to hold the same in a plane with the forward end of the head frame.

When the weaving has been completed the forward end of the net is substantially the same width as the inner edge of the forward end of the head frame, and the width of the remaining portion of the net being wider than the remaining portion of the frame in order that when the netting is laced into the V-shaped head the rear portion of the net is depressed to form the pocket P of predetermined dimensions, as best illustrated in FIG. 4 and 5 for receiving and holding the playing ball.

Figure 23:
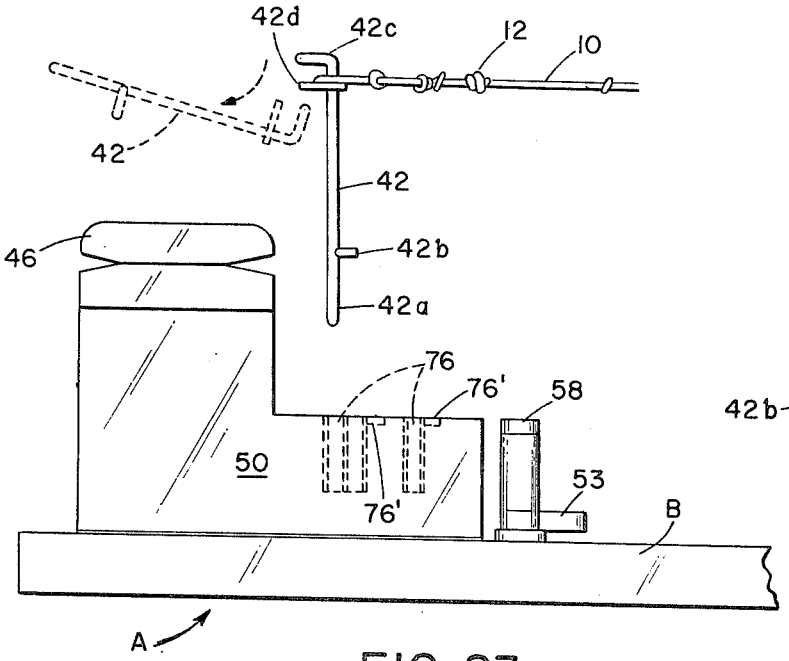
FIG. 23 is a fragmentary view in side elevation of the netting supporting apparatus illustrating the manner in which the woven net is removed from the apparatus after the weaving is completed.
Figure 24:
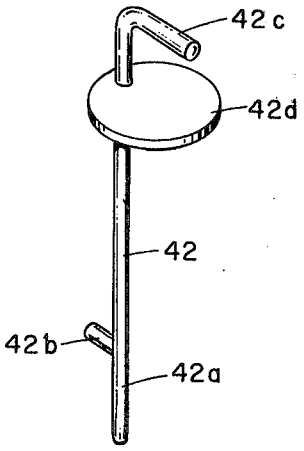
FIG. 24 is an enlarged view of one of the holding pins for holding the horizontal cords as the net is being woven.

Each pin in each group is constructed exactly alike and the description of a single pin should be sufficient for the details of all the pins. FIG. 23 shows one particular type of net supporting pin used with the apparatus J. The pin is formed with an upstanding shank 42 having a lower portion 42*a* adapted to be held within an aperture 76 in the base B. The upper end of the pin is provided with a head 42*c* and preferably a washer-like member 42*d* for keeping the longitudinal cords supported thereon adjacent the top of the pins. The pin 42 is also provided with an extended member 42*b* which is receivable in a slot 76' formed in the base member for preventing the pin from turning from its set position. All pins are substantially the same length and are of such height from the base B as to provide working room between the longitudinal cords and the upper face of the base for weaving in the cross cords.

Referring again to FIG. 2 the net N' is woven with single longitudinal members 64 about which cross cords 66 are looped similar to that described for the net N in FIG. 1 except these cross cords are interlocked in the looping about the longitudinal members and the net is not provided with an additional cover cord as shown and described for the net N in FIG. 1. The longitudinal cords are usually made of natural or artificial leather while the cross cords are normally made of a nylon type cord. The longitudinal cords, or thongs, are provided with means adjacent the outer end such as slots 64'' for receiving the lacing for securing the netting to the head frame. This netting may also be constructed outside the frame in substantially the same manner and on the same apparatus as described hereinbefore.

The net N' may also be treated with a stiffening and covering compound as previously described for the netting N. The nets N and N' may be treated with the stiffening compound before they are removed from the apparatus, or it may be applied after the netting is laced into the head frame. This compound is adapted to partly impregnate and cover the netting and give to the netting additional body and firmness and aid in maintaining the pocket P in its preformed shape.

In addition to the woven nets shown in FIGS. 1 and 2 there are two forms of molded netting. One form is shown in FIGS. 6–8 and the other form is shown in FIGS. 9–11.

Figure 7:
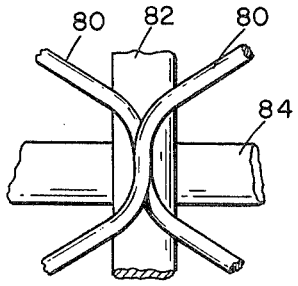
FIG. 7 is an enlarged view in elevation taken along line 7–7 of FIG. 6.
Figure 8:
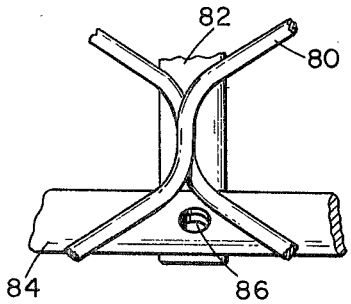
FIG. 8 is an enlarged view in elevation taken along line 8—8 of FIG. 6.

Referring to the form shown in FIGS. 6–8, the netting 80 may be of the conventional molded type net formed in such manner that the forward end of the net is of such width and shape as to snugly fit into the forward end of the head frame while the remaining portion of the netting is wider than the remainder of the head frame for the purpose of forming the pocket P as previously described. The net is supported by longitudinal members 82 and lateral members 84; however, the net may be cut to size to lace directly into the head frame. When the reenforcing strips are used there is a plurality of apertures 86 extending about the periphery of the net to receive means for securing the same to the head frame. When the net is laced into the head frame there will also be a pocket formed in the netting similar to that shown and described for the woven netting.

In the other type of molded netting shown in FIGS. 9–11 the netting is preferably molded into a sheet 90 having a plurality of openings 92. Extending longitudinally of the net are reenforcing cords 93, and extending laterally are reenforcing cords 94. The longitudinal cords 93 extend beyond the forward edge of the netting and are provided with means 93' for receiving a lacing for securing the netting to the head frame.

Both molded nets are molded in substantially rectangular form but the rear portion of the net may be tapered inwardly to form a pocket in the same manner as described for the woven net. This molded form of netting is also provided with apertures 96 through which the lacing may be extended for attaching the net to the head frame.

FIGS. 25 to 27 show a preformed fence K for use with a single wall head frame which is adapted to fit into the open side of the frame. The fence K is molded similar to the net shown in FIGS. 9–11, that is, the fence is similar to a perforated molded sheet. The fence is reenforced with elongated cords 97 extending through or attached to the fence. The loop ends 97' of the elongated cords provide means for receiving a lacing for fastening one end of the fence to the outer end 30' of the head frame (see FIG. 15). The opposite end of the net is secured to the rear end 32 of the frame by the extended ends 97''. The bottom L of the fence is secured through apertures 99 to the reenforcing member 36 or to the side of the net if no support is being used.

An alternate method of securing the longitudinal cords to the forward end portion 16 of the head frame is to provide the forward end of the longitudinal cords with an elongated loop 11 of such length as to extend through the apertures 24 in the toe of the frame and securing the loop by extending a cord 15, or other suitable member, through the loop so that the cord will rest against the under side of the frame when tension is applied on the longitudinal cords in the net area.

While the invention has been shown and described in a particular form it is not intended as a limitation as the scope of the invention is best defined in the appended claims.

I claim:

1. A method of forming nets for lacrosse stick head frames wherein the head frame is formed of two diverging side members joined at a jointure and an outer end member to form a net area of substantially triangular form within the said frame, comprising the steps of preforming an elongated netting, said netting having generally equally spaced interstices and having at least one end of substantially the same width as the outer end of the frame and forming the remainder of the net wider than the area lying between the diverging side members, said netting being of substantially rectangular shape and formed from interlooping longitudinal cords with cross cords and a lapping cover cord about the looped area of cross cords and extending over the loops for protection of loops from wear by a playing ball, tightly lacing the edge of the above-mentioned end of the preformed net to the outer end member and side members adjacent their outer ends and attaching the remaining side edges of the net to the remaining portion of the respective side wall members throughout their length, thereby forming a sloping pocket in the net extending inwardly and downwardly from the outer end member to the opposite end of the net area.

2. A method of forming nets for lacrosse stick head frames wherein the head frame is formed of two diverging side members joined at a jointure and an outer end member to form a net area of substantially triangular form within said frame, comprising the steps of preforming an elongated netting, said netting having generally equally spaced interstices and having at least one end of substantially the same width as the outer end of the frame and forming the remainder of the net wider than the area lying between the diverging side members, said netting being of substantially rectangular shape and formed from interlooping longitudinal cords with cross cords, tightly lacing the edge of the above-mentioned end of the preformed net to the outer end member and side wall members adjacent their outer ends and attaching the remaining side edges of the net to the remaining portion of the respective side wall members thereby causing the netting to form a pocket adjacent the jointure of two side wall members.

3. A method of forming nets for lacrosse stick head frames wherein the head frame is formed by two diverging side walls joined at a jointure and an outer end member connecting the side members to form a substantially triangular net area within said frame, comprising the steps of preparing an elongated netting in which at least one end is substantially the same width as the inner edge of the outer ends of the said diverging side members and forming the remainder of the net of a width not greater than the above-mentioned end of the net but wider than the remaining net area lying between the remaining portions of the said side walls, tightly lacing the edge of the above-mentioned end of the preformed net to the other end member and the side wall members adjacent their outer ends and attaching the edge of the remainder of the preformed net lying within the net area to the remaining portion of the tapered side walls of the frame thereby causing the netting to form a pocket adjacent the jointure of the two side members.

4. A method of forming nets for lacrosse stick head frames as set forth in claim 3 including the step of forming the netting in a substantially rectangular form.

* * * * *